US007076988B2

(12) United States Patent
Venäläinen

(10) Patent No.: US 7,076,988 B2
(45) Date of Patent: Jul. 18, 2006

(54) STRAIGHTENING BENCH OF THE CAR BODY

(75) Inventor: Olavi Venäläinen, Kuopio (FI)

(73) Assignee: Autorobot Finland Oy, Kuopio (FI)

( * ) Notice: Subject to any disclaimer, the term of this patent is extended or adjusted under 35 U.S.C. 154(b) by 0 days.

(21) Appl. No.: 11/210,560

(22) Filed: Aug. 23, 2005

(65) Prior Publication Data

US 2005/0279153 A1 Dec. 22, 2005

Related U.S. Application Data

(63) Continuation of application No. PCT/FI2004/00095, filed on Feb. 25, 2004.

(30) Foreign Application Priority Data

Feb. 26, 2003 (FI) ..... 20030295

(51) Int. Cl.
*B21D 1/12* (2006.01)

(52) U.S. Cl. ..... 72/447; 72/705

(58) Field of Classification Search ..... 72/457, 72/705, 447

See application file for complete search history.

(56) References Cited

U.S. PATENT DOCUMENTS 3,292,410 A * 12/1966 Baldassano ..... 72/297
4,070,899 A * 1/1978 Venalainen ..... 72/457
4,660,405 A * 4/1987 Widegren et al. ..... 72/447

FOREIGN PATENT DOCUMENTS

WO WO 92/18263 10/1992
WO WO 98/09742 3/1998

* cited by examiner

*Primary Examiner*—Lowell A. Larson
(74) *Attorney, Agent, or Firm*—Harrington & Smith, LLP

(57) ABSTRACT

The present invention relates to a straightening bench of the car body, which includes a straightening table of a car, to which the car is attached, a straightening beam attached to the straightening table, a pulling element for a straightening pull, which pulling element is possible to be attached to the straightening beam as well as attached to the car body for straightening pull of a car, and a transfer device attached to the straightening beam for moving the pulling element. The straightening bench in accordance with the invention includes an outer beam to be connected to a straightening table, an inner beam to be detachably attached to it and to be moved in regard to it, to which inner beam the straightening beam has been attached and a slide connected to a transfer device and placed to the inner beam and which is to be moved in regard to it by means of a transfer device, to which slide a pulling element has been attached and which slide has been arranged to move the pulling element and which slide is possible to be attached to the inner beam in order to move it and the straightening beam in regard to the outer beam.

6 Claims, 4 Drawing Sheets

STRAIGHTENING BENCH OF THE CAR BODY

This application is a continuation of International Patent Application No. PCT/FI2004/000095 filed Feb. 25, 2004.

The present invention relates to a straightening bench of the car body, which comprises a straightening beam attached to a straightening table of a car body, a pulling element for a straightening pull, which pulling element is possible to be attached to the straightening beam as well as to the car body for a straightening pull of the car, and a transfer device attached to the straightening beam for moving the pulling element.

BACKGROUND OF THE INVENTION

In crash repairs of cars for straightening of their bodies and other parts various straightening apparatus are used. In these apparatus, there are straightening tables or similar, and fastening devices in them, with which a car is attached on a straightening table as well as pulling devices, with which constructions of a car are straightened by pulling.

Constructions of a car are made of materials, such as special steels, with the use of which a firm and strong construction is achieved. The fact that these materials need strong straightening forces must be taken into account while repairing and straightening cars. As the materials used today are stronger by their characteristics than earlier materials, stronger forces are needed in straightening work now. Strong straightening forces influence the point to be straightened during straightening work and one must look after that these straightening forces are directed or may influence only the damaged area and do not have changing influence on undamaged areas. In case this is not taken into account, undesired changes may be caused to other, undamaged areas of a car while straightening a damaged area. In addition, it must be looked after that the forces needed for straightening are not directed to attaching parts of a car body and they do not damage them. In present devices these facts are not usually taken into account.

The object of the invention is to provide a straightening bench with the use of which it is possible to take into account the earlier mentioned disadvantages. Especially, the object of the invention is to provide a straightening bench with the use of which it is possible, with the same device, to carry out a traditional straightening pull, separate pushing movement and combined pull/push straightening movement. In addition, the object of the invention is to provide a straightening bench, which is easy to use.

DESCRIPTION OF THE INVENTION

The straightening bench in accordance with the invention comprises an outer beam to be connected to a straightening table, an inner beam to be detachably attached to it, and to be moved in regard to it, to which inner beam the straightening beam has been attached, and a slide connected to a transfer device and placed to the inner beam and which is to be moved in regard to it, to which slide a pulling element has been attached and which slide has been arranged to move the pulling element and which slide is possible to be attached to the inner beam in order to move it and the straightening beam in regard to the outer beam. With this kind of a straightening bench, an efficient pulling movement is created. In addition, in the straightening bench it is possible to move the straightening beam and devices attached to it in desired way in regard to the car.

In an advantageous application of the invention the device comprises a supporting arm to be attached to a straightening beam, which supporting arm may be moved against a car body for keeping the point of the car in place during the straightening pull. The supporting arm may be placed to the desired point of the car construction to support it and in that way the point or points in question may be supported during the straightening pull. By means of the pushing rod that area of the car body or frame of the car, which must not move from its location during the straightening pull itself, may be kept in place and supported. In this case the pulling stress can be directed and it may be directed as strong and exact to those parts and areas, which are straightened, but the pull does not influence other areas and they are not damaged. Therefore, the bigger straightening forces that are needed in case of new body models are not directed or have no influence on undamaged areas of a car but they influence only the damaged area. This causes also the benefit that damage may be easier repaired.

In an advantageous additional application of the invention an inner beam reaches at least partly inside the outer beam and may be moved along its vertical direction. In this case the inner beam leans partly on the outer beam and the inner beam is easy to be move. In addition, the construction is simple and reliable in use.

In the next advantageous additional application of the invention the transfer device is a double-acting hydraulic cylinder, which has been attached to a slide and to an outer beam. The double-acting hydraulic cylinder is easy to use and with it a motion to both direction is reliably achieved.

In the next additional application of the invention the device comprises a locking device for attaching the slide detachably to the inner beam. By means of a separate locking device it is possible to attach and to detach the slide easily to the inner beam.

DESCRIPTION OF THE DRAWINGS

Next, the invention will be explained in more detail with reference to the accompanying drawings, in which.

FIG. 1 illustrates a straightening table 1 of a car body, on which bench a car is attached for straightening. The figure illustrates the straightening table lifted to the working position, even though the car is not presented. In addition, the figure illustrates the straightening bench 2, 3, 4, 5 attached to a straightening table such that it may be turned and adjusted to various positions in a recognized way.

FIGS. 2–4 illustrate in more detail the construction of the straightening bench in accordance with the invention. It comprises an outer beam 6, an inner beam 7, a straightening beam 2, 3, a slide 8, a transfer device 5, a pulling element 4 and a supporting arm 9. The outer beam has been connected in accordance with FIG. 1 to the straightening table such that it may be turned by means of a recognized turning device. The inner beam has been attached detachable to the outer beam, which inner beam reaches partly inside the outer beam and has been arranged to be moved along its longitudinal direction. The straightening beam has been attached to the inner beam and the straightening beam comprises a vertical beam 2, and to the head of it, the upper beam 3 has been attached such that it may be turned.

Figure 1:
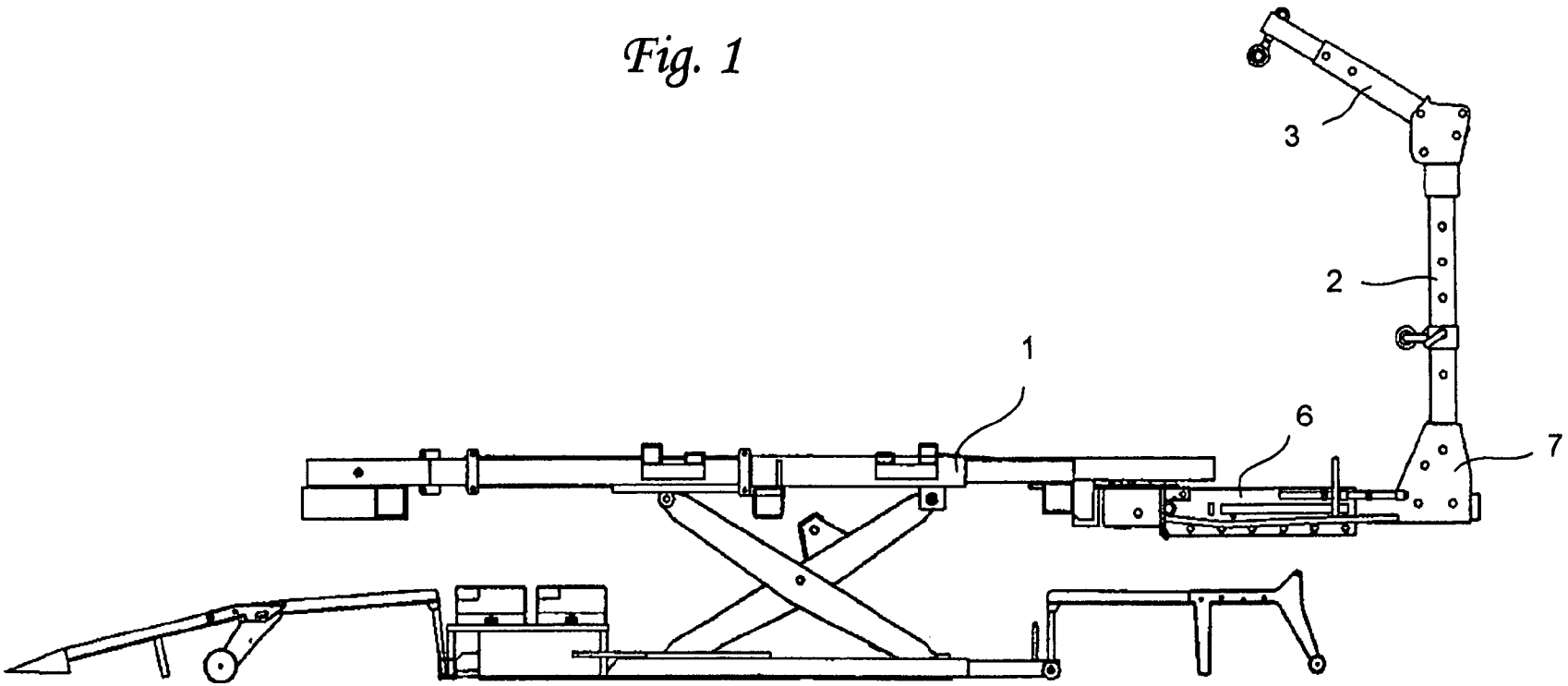
FIG. 1 illustrates an application of a straightening table of a car body and a straightening bench in accordance with the invention viewed from side.
Figure 3:
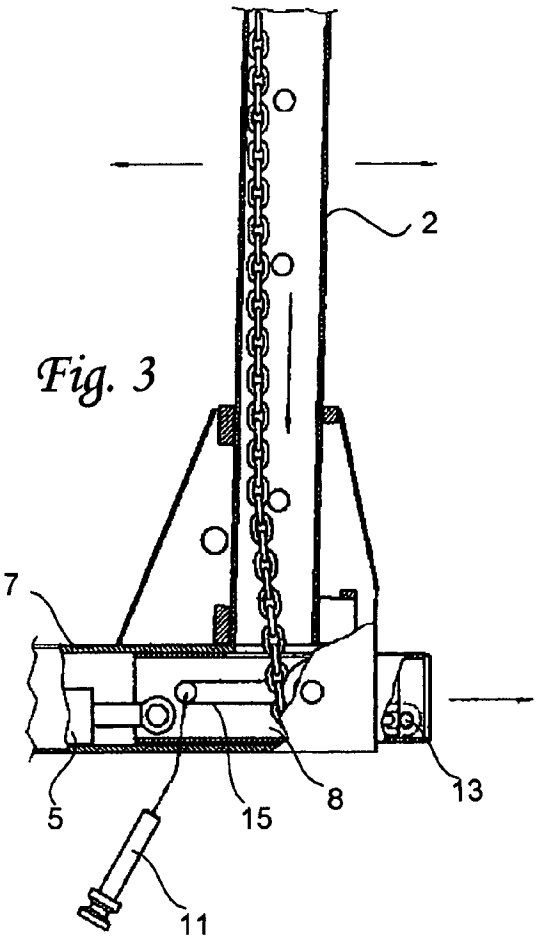
FIG. 3 illustrates a cross-section of a part of the straightening bench in accordance with FIG. 2.
Figure 4:
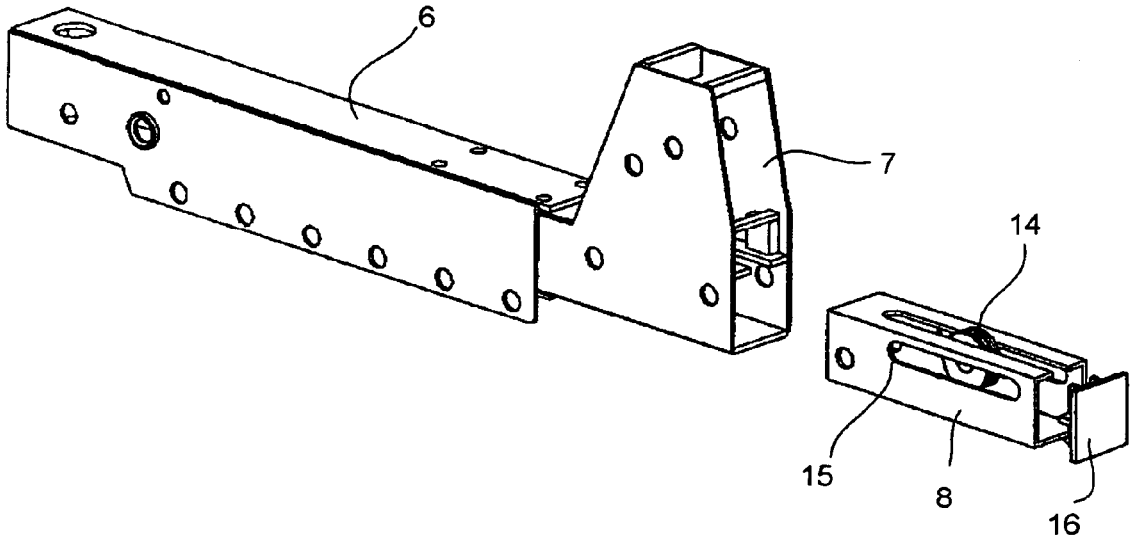
FIG. 4 illustrates some parts of the straightening bench presented separately.

The slide 8 included in the bench and presented in FIGS. 3 and 4 has been placed at least partly inside the inner beam and it is movable along the longitudinal direction of the inner beam by means of the transfer device. A chain functioning as a pulling device (4) has been arranged to go inside the vertical beam, it reaches the slide in the inner beam inside the vertical beam and has been attached to an attaching element or to the fastening pivot 13 in the slide. In addition, there is a supporting element or a chain wheel 14 in the slide, through which the pulling element has been directed to go to the fastening pivot. The chain wheel 14 has been attached with an axle to the inner beam and on the sides of the slide elongated openings or holes 15 have been formed for the axle of the chain wheel such that the chain wheel stays in place while moving the slide. To the other end of the slide reaching outside the inner beam, a supporting part 16 has been formed, which supporting part is supported against the outer surface of the inner beam, and in that case it may move the inner beam towards the outer beam.

Figure 2:
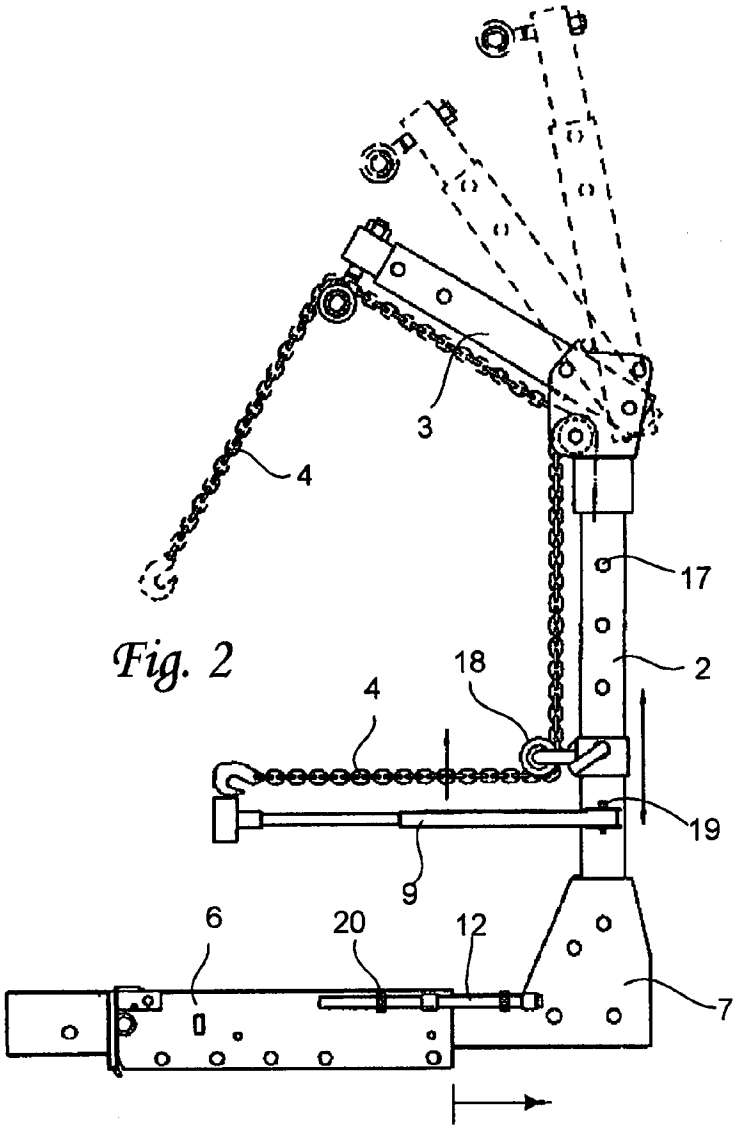
FIG. 2 illustrates a straightening bench of a car body in accordance with FIG. 1 viewed from side.

There are openings 17 functioning as attaching points in a recognized way at a certain distance from each other on the vertical beam and the upper beam of the straightening beam, in which case the turning chain wheels 18 functioning as attaching devices of the pulling element may be fastened to a desired point in the straightening beam and the pulling device is possible to reach the construction of the car from the desired direction. In addition, FIG. 2 illustrates with dashed lines the vertical beam in its various positions. In addition, FIG. 2 illustrates a supporting arm 9 fastened with the attaching element 19 to an attaching point, which supporting arm is an elongated, shaft-like element in one end of which there is a wide support. In the attaching element (19) in question there is a hinge such that the supporting arm may be turned to the desired position both in vertical and in horizontal directions in regard to the vertical beam and correspondingly to the car. One or more pushing rods may be used in the straightening bench.

FIG. 3 illustrates a head attached to the slide of the transfer device 5. The transfer device is a double-action hydraulic cylinder fixed to the slide and the outer beam. In addition, FIG. 3 illustrates the locking element 11 included in the device for attaching the slide detachable to the inner beam. The locking element is a locking pivot, which may be placed to openings in the inner beam, and to elongated openings made to the slide at the points of the openings.

In addition the device comprises an adjusting device 12 attached to the outer surface of the outer beam and the inner beam, which adjusting device has been illustrated in FIG. 2. There are screw guides 20 in the adjusting arm functioning as an adjusting device, by means of which the position of the adjusting arm may be changed. By adjusting the screw guides of the adjusting arm the motion of the inner beam may be adjusted in regard to the outer beam relatively easily and simply.

Figure 5:
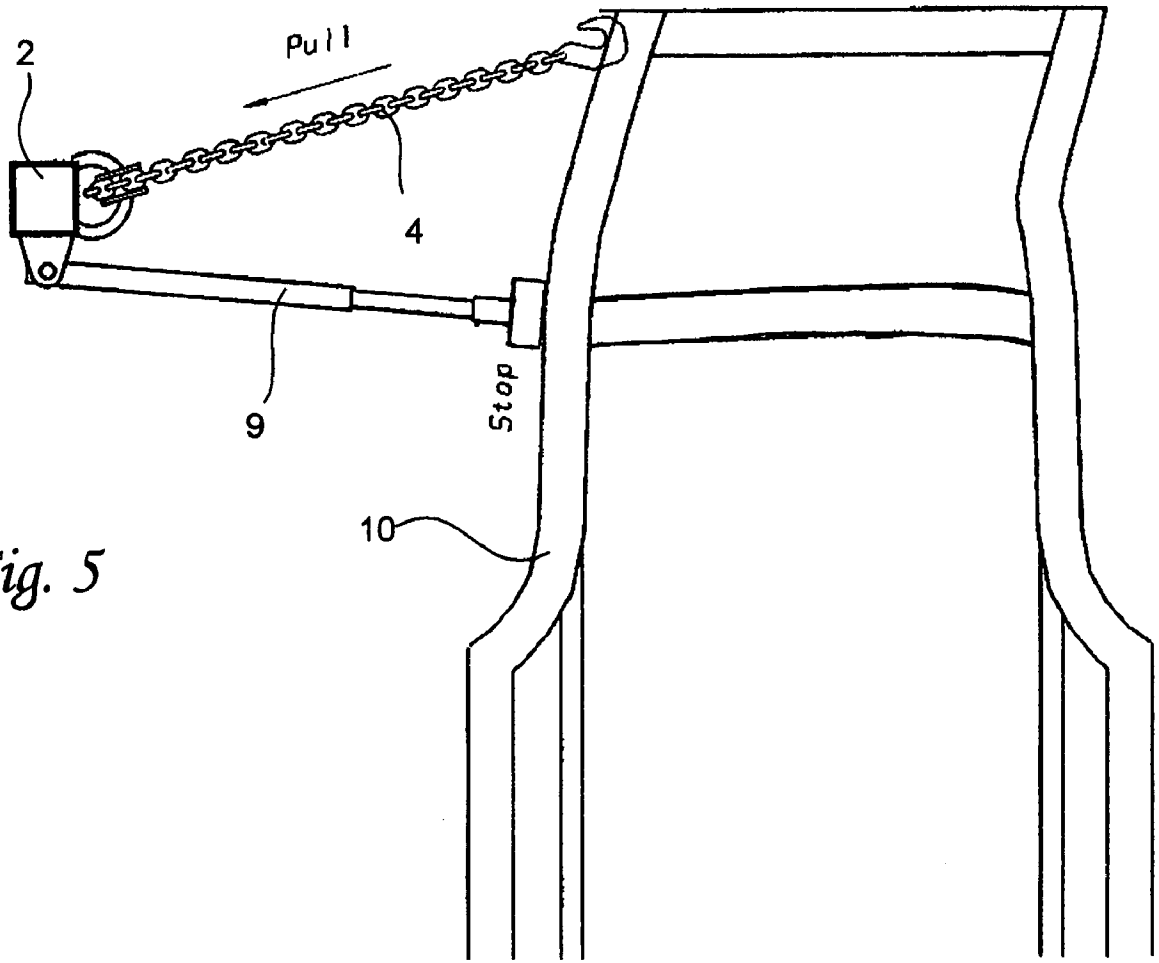
FIG. 5 illustrates the use of a straightening bench in accordance with the invention schematically and viewed from above.

While using the straightening bench in accordance with figures the straightening bench and the straightening beam are placed to the desired point of the car and the pulling element 4 is attached to the desired point of the car body or to some other construction. Before straightening pull, the supporting arm 9 is placed to its place against the car 10 in a way presented in FIG. 5, for example. By means of the pulling move of the hydraulic cylinder the slide, the inner beam and the straightening beam may be moved towards the car and the supporting arm kept in place and to support the body area at its point. After this the pulling move of the hydraulic cylinder is locked with the locking device and the pushing move is changed to the hydraulic cylinder, that is, the slide is moved with the hydraulic cylinder to the right, to the direction of the arrow illustrated in FIG. 3. In this case the slide moves right and the pulling element moves with it, in which case the pulling element gets tighter and the actual straightening pull is achieved.

While the slide is locked to the inner beam with the locking pivot and the slide is moved with the hydraulic cylinder to the opposite direction, that is, to the left in FIG. 3, the inner beam and the straightening beam are moved with the slide to that direction. In this case the supporting arm is located against the car body and a pushing movement is achieved. The length of the pushing/supporting movement of the pushing rod is limited with the adjusting device by adjusting the adjusting device to a certain point, in which case the motion stops while the adjusting arm reaches that certain point.

Various kinds of functions related to straightening may be carried out with the straightening bench. By means of it, a traditional pulling motion may be provided in the way presented earlier. In addition, while using the same device desired points of a car may be supported simultaneously during pulling. Further, the device may be used only to push some car body area away. The device may also be applied in periodical pull/push motion, in which case the move of the hydraulic cylinder is changed at certain intervals and successive pulling and pushing functions are created.

The invention is not limited to the presented advantageous application but it can vary within the frames of the idea of the invention formed in the claims.

The invention claimed is:

1. Straightening bench of the car body, which comprises a straightening table of a car body, to which the car is attached, a straightening beam attached to the straightening table, a pulling element for a straightening pull, which pulling element may be attached to the straightening beam and to the car body for a straightening pull, a transfer device connected to the straightening beam for moving the pulling element, an outer beam to be connected to the straightening table, an inner beam to be detachable attached and moved in regard to the outer beam, to which inner beam the straightening beam has been attached, and a slide connected to the transfer device, placed in the inner beam and movable by the transfer device in regard to the inner beam, the pulling element has been attached to the slide, and the slide has been arranged to move the pulling element and may be attached to the inner beam for moving it and the straightening beam in regard to the outer beam.

2. Straightening bench in accordance with claim 1, which comprises a supporting arm to be attached to the straightening beam, which supporting arm is to be moved against the car body for keeping the car body area in its place during the straightening pull.

3. A straightening bench in accordance with claim 1, in which the inner beam reaches at least partly inside the outer beam and is movable along its longitudinal direction.

4. A straightening bench in accordance with claim 1, in which the transfer device is a double-action hydraulic cylinder, which has been attached to the slide and to the outer beam.

5. A straightening bench in accordance with claim 1, further comprising a locking element for locking the slide detachable to the inner beam.

6. A straightening bench in accordance with claim 1, further comprising an adjusting device attached to the outer beam and the inner beam.

* * * * *